US005996305A

United States Patent [19]

Holbert et al.

[11] Patent Number: 5,996,305

[45] Date of Patent: Dec. 7, 1999

[54] ASSEMBLY OF WOOD I-BEAMS

[75] Inventors: John C. Holbert; Steven L. Hering, both of Corvallis, Oreg.

[73] Assignee: Corvallis Tool Co., Philomath, Oreg.

[21] Appl. No.: 09/073,905

[22] Filed: May 6, 1998

[51] Int. Cl.[6] ..... E04C 3/14

[52] U.S. Cl. ..... 52/745.19; 52/729.4; 29/897.35

[58] Field of Search ..... 29/897.35; 52/729.4, 52/745.19

[56] References Cited

U.S. PATENT DOCUMENTS

| | | | |
|---|---|---|---|
| 4,715,162 | 12/1987 | Brightwell | 52/729.4 |
| 4,967,534 | 11/1990 | Lines | 52/729.4 |
| 5,323,584 | 6/1994 | Scarlett | 52/729.4 |

*Primary Examiner*—Christopher T. Kent
*Attorney, Agent, or Firm*—Robert L. Harrington

[57] ABSTRACT

A machine and process for assembling flanges to a web to produce an I-beam. The machine has conveyors for conveying each flange and a separate conveyor system for conveying the web. The web is rigidly held to prevent lateral movement as the flanges and web are assembled. The conveyance mechanism for the webs is adjustable upwardly and downwardly to accommodate changes in the flange dimension and web thickness. The conveyance mechanism for the web is mounted on inclined ramps. Movement of the conveyance mechanism in one direction elevates the conveyance mechanism and movement in the other direction lowers the conveyance mechanism. The flanges as conveyed are sensed and relatively adjusted to assure alignment of the leading ends.

10 Claims, 5 Drawing Sheets

41
39
38
12
40
28
40
14
60
58
37

ASSEMBLY OF WOOD I-BEAMS

FIELD OF THE INVENTION

This invention relates to the production of wood I-beams and more particularly it relates to the machinery and process for assembly and securing the flanges and web together to produce I-beams.

BACKGROUND OF THE INVENTION

Overhead support beams used for building structures have long been made of wood as well as steel. Whereas steel beams are typically in the form of what are referred to as I-beams, having upper and lower flanges connected by a web and thus resembling the letter I, wood beams have historically been made in the form of rectangles, i.e., 4"×6", 4"×8", etc. A restriction on the use of rectangular wood beam supports is the size of a beam that can be produced from available tree sizes which over the years have become smaller and smaller.

A process of producing wood I-beams has been developed which does not rely on tree or log size. Flanges are produced by the process referred to as LVL or laminated veneer layers and the web between the flanges is produced by the process referred to as OSB or oriented strand board. The LVL process stacks sheets of veneer that are typically 4' wide and 8' long and, e.g., 0.1" thick. The ends of the sheets are scarfed and end spliced together (glued) to extend the length as desired. The spliced ends of overlying sheets are staggered to produce a consistent strength throughout the length and the elongated stacks are cut into strips, e.g., having a thickness of 1½" to 3½", a width of 4" and a length of 28' to 65'.

The OSB process involves first reducing a wood material to strands which are then oriented in a common direction to produce strand layers. Alternating overlying layers have the strands oriented 90° from the underlying layers and the layers are added as desired to achieve the desired thickness. Again the boards produced from the strands are cut into strips to achieve the thickness, e.g., ⅜" and width, e.g., 7½" as desired for the web of the I-beam. The webs are not continuous and, e.g., 4' or 8' lengths are end butted between the flanges to produce the desired lengths of the I-beams.

The challenge then is to assemble the web strips (webs) and flange strips (flanges) together as an I-beam. In a known process, the web segments are provided with tapered side edges of a precise configuration and the flanges are provided with mated grooves. Glue is applied to the tapered sides and/or grooves and as the components are conveyed along a path, the flanges are guided onto the tapered side edges at each side of the web and the assembly of the center web and side flanges is compressed between rollers to squeeze the tapered side edges of the web into the grooves of the flanges. The compression rollers insure that the overall dimension between the outside faces of the flanges conforms to an established dimension, i.e., the dimension intended with the side edges of the web properly seated in the grooves of the flanges.

The above process has at least three deficiencies to which the present invention is directed. As the flanges and web are brought together and compressed, any variation in the groove size, tapered side edges, glue deposited or even surface imperfections (within the groove or on the tapered edges) will cause one side of the web to be more resistive to being seated in the groove than the other side. The result may be that one side is inserted to a greater depth than the other which produces bowing or skewing of the beam and can even produce cracking of a flange.

The process is continuous, e.g., producing repeated 28' to 65' I-beams with the flanges following one after the other as they are guided into the assembly process. The LVL board lengths (from which the flange strips are generated) are typically not precisely the same lengths (e.g., there can be ¼" variance in a 30' to 65' length), and accordingly as the flanges from one board follow another board, there can be a slight disparity between the lengths of the flanges from one side of the I-beam to the other. Whereas a slight disparity can be tolerated, a series of mismatches compounds the difference and produces an unacceptable disparity. This requires periodic resetting of the stream of flanges and on occasion generates a rejected I-beam which is too short for that run of I-beams and will have to be cut down to a shorter standardized length. This is a costly waste of production and undesirable.

The third deficiency is the required shut down for resetting of the machinery when a change to a different I-beam size is required. There are numerous machines involved and all or most require adjustment relative to the conveyor when the I-beam depth or flange size is varied. This shut down is extremely expensive and reducing the shut down time is highly desirable.

BRIEF SUMMARY OF THE INVENTION

The process of the present invention departs from the manner by which the flanges are fit to the web, i.e., the prior process being to force the two flanges onto the web at a pre-set width determined from the outside face of one flange to the outside face of the other flange. (The reader will understand that the term "width" is used to measure the lateral dimension during processing. When installed during construction, the I-beam is rotated 90 degrees and the width dimension as used here then becomes the height dimension.)

In the present invention, the desired web path is established and the web is fixed in that path by a clamping action of the conveyor. In the preferred embodiment, the web is conveyed using upper and lower conveyors (one being a sharp chain conveyor) to clamp and hold the web in the centered position. The desired half width, i.e., as between the center of the web and the outer side (outside face) of the flange is determined. The flanges are guided and urged into the seated position for each side of the web and the pressure rollers that urge the flanges onto the web sides are prevented from applying excessive pressure. Thus, each of the flanges are urged to a prescribed fixed position measured from the fixed center line of the web. If one side is more resistive to assembly, that resistance will not be transferred to the other side. In the event that one side cannot be properly assembled onto the web, the pressure rollers will release and sensors will signal the existence of a flawed section in the I-beam. The accepted I-beams will not have one flange more deeply seated than the other to which can happen in the prior process.

As concerns the problem of accumulating a length disparity as between the flanges, the first improvement is the feeding of flanges to the conveyor in alternating fashion. That is, the flanges that are cut from, e.g., a 48" LVL board into thirty-two 1½"flanges are fed alternately to one side of the web and then the other. This is followed by thirty-two flanges cut from a next same board. As the flanges from the same board are exactly the same length, the accumulated length disparity as between the flanges of the two sides of the I-beam is greatly diminished. As concerns the disparity that eventually will unacceptably accumulate, the conveyor system is further provided with sensors to detect the discrepancy as between the leading ends of the pair of flanges. As the leading ends of the flanges pass the sensors, should one flange slightly follow the other, the drive roll speed under the flange that is leading is retarded to insure that the leading ends are fed evenly into the assembly process. The disparity of different length flanges is thereby prevented from accumulating. In that the saws that cut the I-beam to length following assembly are about ¼" in width and the disparity is rarely greater than ¼", the beams can be cut at the exact same length regardless of the disparity.

The problem of machine adjustment to different I-beam sizes is addressed. The automated process for assembling the flanges to the webs includes feeding the flanges edgewise in spaced apart relation, cutting elongated grooves along a center line at the inner side of both flanges, positioning a web between the flanges with the side edges aligned with the grooves and guiding the grooves of the flanges onto the side edges of the web. The machines that are involved in this process include, e.g., saws, conveyors and press rollers. The I-beam specifications change wherein the desired I-beam may have flanges 1½", 2½" or 3½" in width and the web thickness may change between ⅜" to ½". Previously when this change was made to the automatic assembly, the conveyor for feeding the web remained fixed and the rest of the assembly machines were manually adjusted to accommodate the web height established by the conveyor.

Applicant's invention provides for at least partially automated changeover. In the preferred embodiment, the flange conveyor remains unchanged and the saw height, web conveyor and rollers are all raised or lowered to accommodate the flange height. All of the machinery is essentially adjusted to the location of the center groove in the flanges and this location changes as the flange width changes. For example, if converting from a 2½" flange to a 1½" flange with a ⅜" web, the web needs to be lowered to fit in the groove and is dropped down by one-half the difference in flange height. In the present example, this is ½". All of the machines that follow the groove height thus need to be lowered ½".

A separate support is provided for the flange conveyors and for the machines that have to be adjusted to the flanges, e.g., the web conveyor. The machines to be adjusted are supported on superimposed upper and lower wedge members (or cams) having mated interfaces angled relative to the underlying level support surface, e.g, by 3 degrees. The upper wedge member or cam is fixed to the machine base and the lower member is slidable. All of the movable wedge members or cams are rigidly tied together, e.g., with rigid rods. A pair of cylinders, one attached at each end of interconnected upper web members and tie rods, are controlled to pull the movable cam to either raise or lower the supported machinery. Each machine supported on the superimposed cam members is accordingly raised or lowered by the same amount which in the present case is ½".

The various features of the invention will be more fully appreciated and understood upon reference to the following detailed description and drawings referred to therein.

DESCRIPTION OF THE PREFERRED EMBODIMENT

Figure 1:
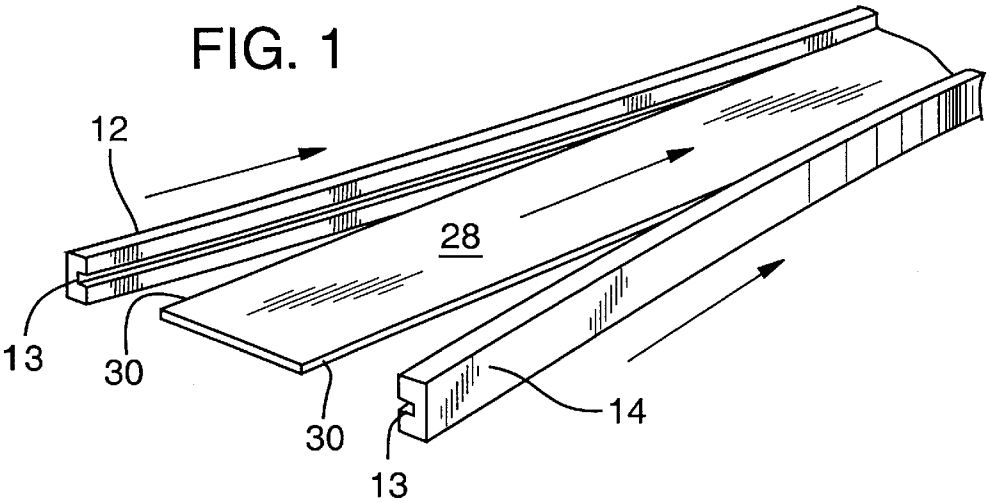
FIG. 1 is a schematic illustration of a web and flanges being assembled.

The present invention is a machine and process for assembling flanges to a web to produce I-beams. In this embodiment veneer layers are laminated together to produce the desired thickness of the flanges. The laminated veneer layers are produced in large sheets and strips having the desired width are simply sawn from the laminate sheet to produce the desired flanges. With reference to FIG. 1, milled tapered grooves 13 are provided in each flange 12 with the groove extending along the length and being positioned centrally on the inside of the flange. The webs 28 are produced by a process referred to as oriented strand board whereby wood fiber strands are layered to produce a desired thickness and cut into, e.g., 8' long strips having a width corresponding to the desired web lengths. The side edges 30 of the web strips (webs) are tapered to fit in the tapered grooves 13 of the flanges. Whereas the tapered groove and edges are deemed preferable, the primary objective here is to provide a mated fit between the groove and edges which may be accomplished with, e.g., straight sides, considered more difficult to produce and align for assembly purposes.

Figure 2:
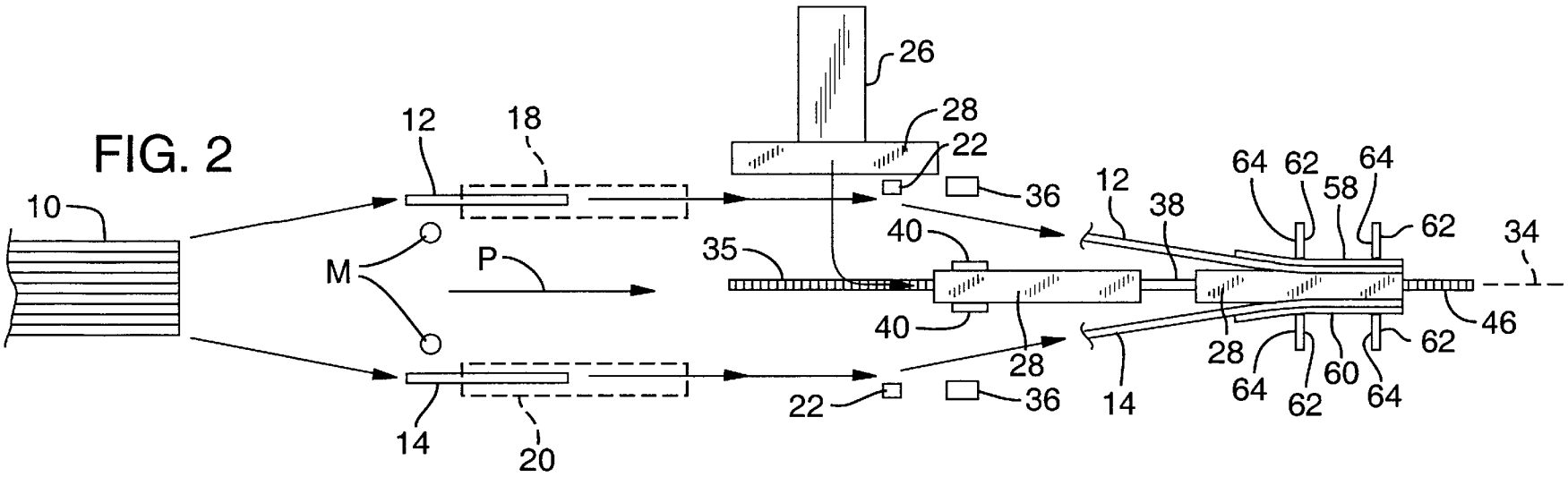
FIG. 2 is a top view diagram illustrating the machine and process for assembling flanges to webs to produce I-beams in accordance with the invention.

The diagram of FIG. 2 illustrates an assembly of machines and a process used to produce I-beams in accordance with the present invention. Flanges 12 and 14 are sawn from the base laminate sheet 10. Formed tapered grooves 13 are milled into the inner face of each of the flanges 12 and 14 (see FIG. 1) by a milling machine as indicated by the letter M in FIG. 2. The assembly machine has conveyors 18 and 20 for conveying the flanges 12 and 14 along the assembly path, the path being designated by arrow P. The flanges 12, 14 are transported on one side edge and the conveyors 18, 20 have a guide such as a trough to maintain the flange's side edge orientation. Sensors 22 are provided to sense the leading end of each of the flanges 12 and 14 as they are being conveyed on the conveyors 18 and 20. The sensors 22 will determine whether or not one of the ends of the flanges 12, 14 is leading the other. It is desirable that the flanges 12, 14 be transported with the leading ends in alignment to assure a proper assembly of the flanges 12, 14 to the web 28. Should one end of one of the flanges 12, 14 be leading, the conveyor transporting the leading flange is slowed down such that the leading end of the flanges 12, 14 come into alignment. The technology for accomplishing this control of one side versus the other is known, e.g., for aligning veneer sheets which process is more fully described in commonly owned U.S. Pat. No. 4,905,843.

As shown in FIG. 2, flange 12 is conveyed by conveyor 18 along one side of the assembly machine and flange 14 is conveyed by conveyor 20 along the opposite side of the assembly machine. The flanges 12, 14 are conveyed on edge with the grooves 13 of each flange facing the center of the assembly machine. The flanges 12, 14 are thus spaced apart a sufficient distance such that a web conveyor 26 may deliver a web 28 and place a web between the flanges 12 and 14. In this embodiment, the web conveyor 26 delivers the webs 28 from the side of the assembly machine. The web conveyor 26 places the web 28 at a known reference between the flanges 12 and 14 on a lug type conveyor 35.

In this embodiment the reference line 34 coincides with the centerline of the conveyance mechanism that conveys the web 28 along a path between the flanges 12 and 14. The reference line 34 thus also coincides with the centerline of the web 28 being conveyed between the flanges 12 and 14.

The web conveyor 26 conveys the webs 28 sequentially onto the lug type conveyor 35. The lug type conveyor 35 transfers the webs 28 in sequence to a roller type conveyor 38. Guide members 40 accurately position the web 28 on the roller type conveyor 38 so that the centerline of the web 28 coincides with the reference line 34.

Figure 3:
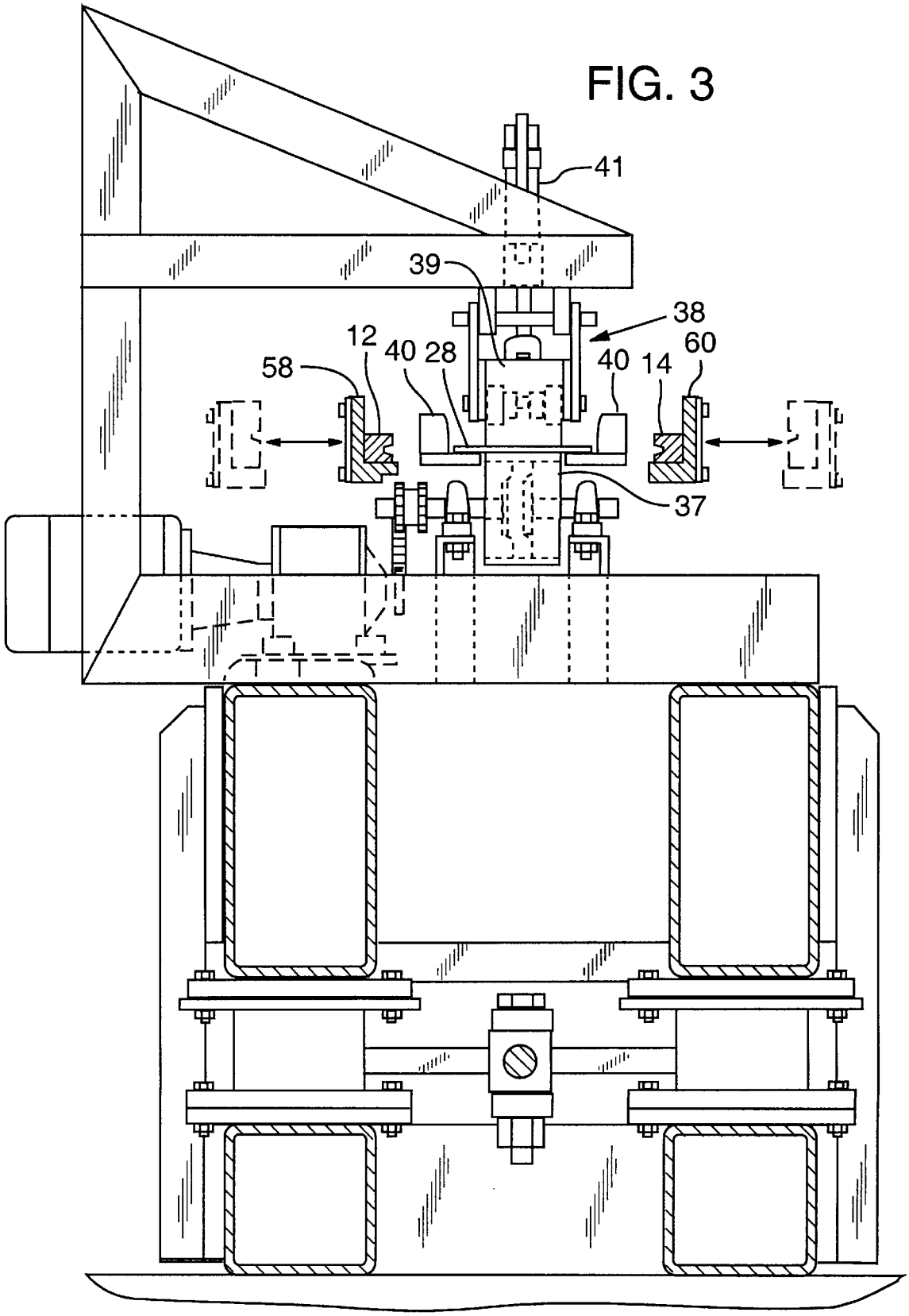
FIG. 3 is a sectional view as taken on section lines 3—3 of FIG. 4 illustrating the machinery of FIG. 4 and the manner by which a web is positioned at a reference position between opposed flanges.
Figure 4:
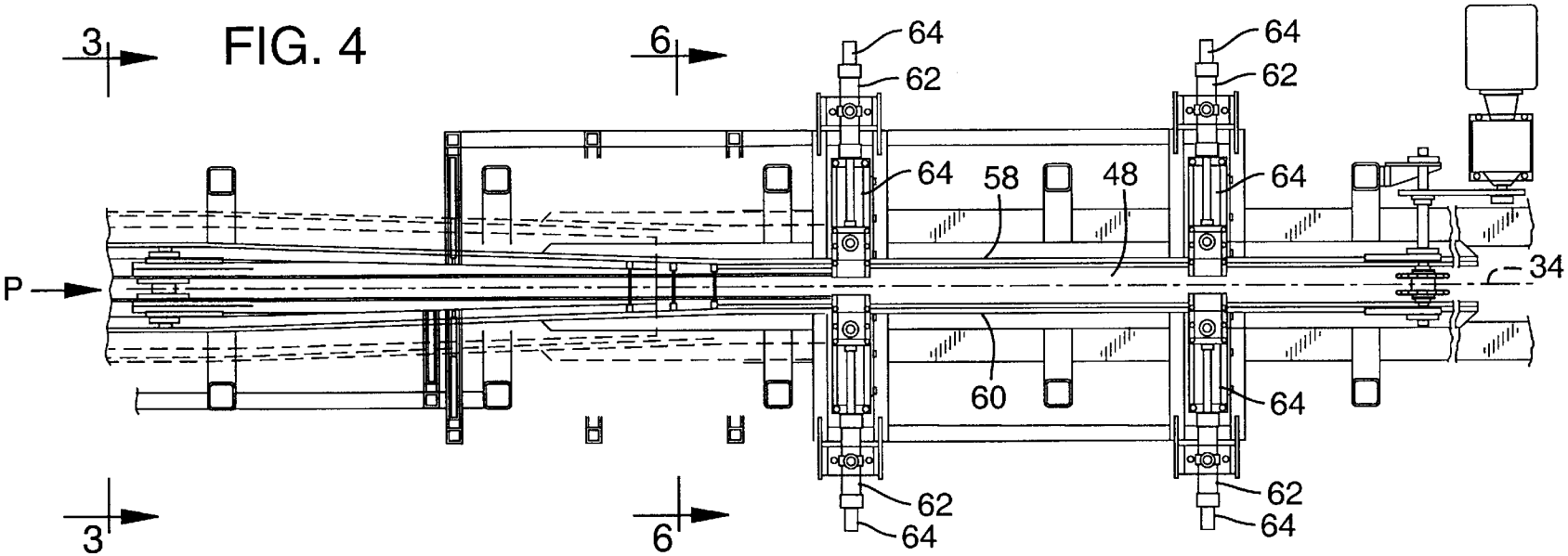
FIG. 4 is a top plan view of a sharp chain conveyor for transporting the web along a reference position.
Figure 5:
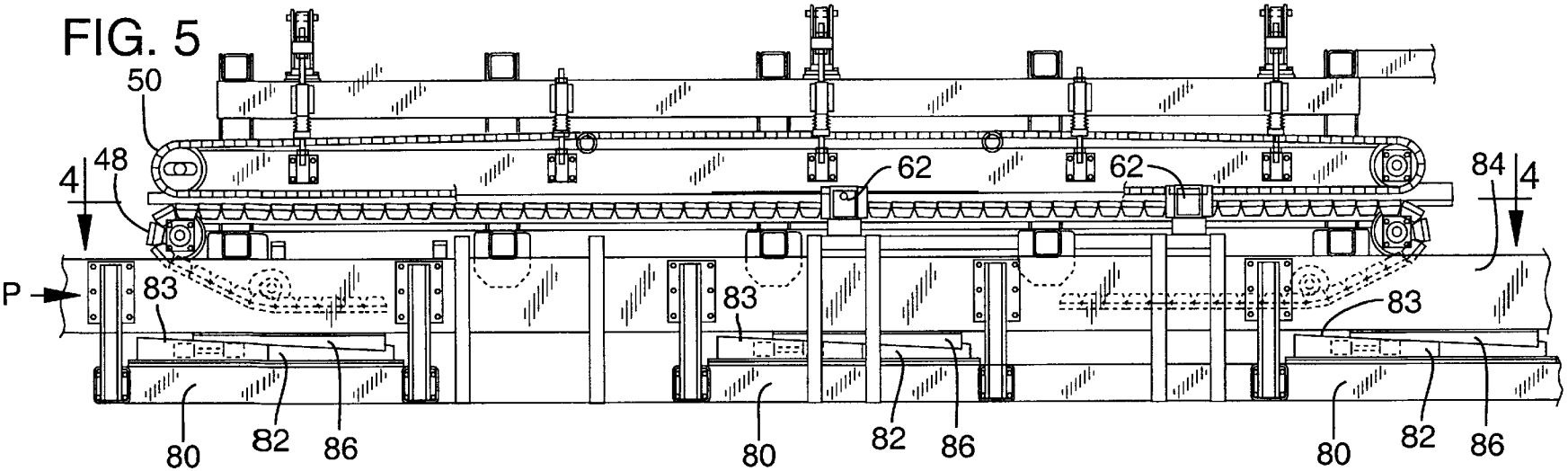
FIG. 5 is a side elevation view of the sharp chain conveyor of FIG. 4.

The roller type conveyor 38 is of the pinch roll type that has bottom rollers 37 and top rollers 39 (see FIG. 3). The top rollers 39 are adjustably mounted and are movable toward and away from the bottom rollers 37 by a cylinder 41. The top roller 39 is essentially adjusted according to the thickness of the web 28. The roller conveyor 38 (rollers 37 and 39) conveys the web 28 onto a gripping conveyor such as a sharp chain conveyor generally indicated as 46 in FIG. 2. The sharp chain conveyor 46 has a lower chain conveyor 48 and an upper chain conveyor 50 as shown in detail in FIG. 5. The lower conveyor 48 and the upper conveyor 50 cooperatively grip or clamp the web 28 between them so that the web 28 will be accurately positioned and rigidly aligned on the conveyor such that the web 28 will not move laterally as it is being propelled by the sharp chain conveyor 46.

The roller conveyor 38 conveys the webs 28 at a higher rate of travel than the sharp chain conveyor 46. Sensors 36 are provided to sense the position of leading ends of the flanges 12, 14 and the first web 28. Succeeding webs 28 are forced into abutment with a preceding web 28 by the conveyor 38. The conveyor 38 has smooth rollers allowing the conveyor to slip when it has forced the succeeding web 28 into abutment with the preceding web 28.

Each succeeding pair of flanges 12, 14 have their leading ends aligned. The sensors 22, 36 determine whether or not the leading ends are in alignment. In this embodiment the I-beams are produced to the length of the flange pair (12, 14). The alignment of the ends of each pair of flanges eliminate any cumulative error due to length variation between flanges. After assembly, the I-beam is cut to the flange length by a known cut-off saw.

Figure 6:
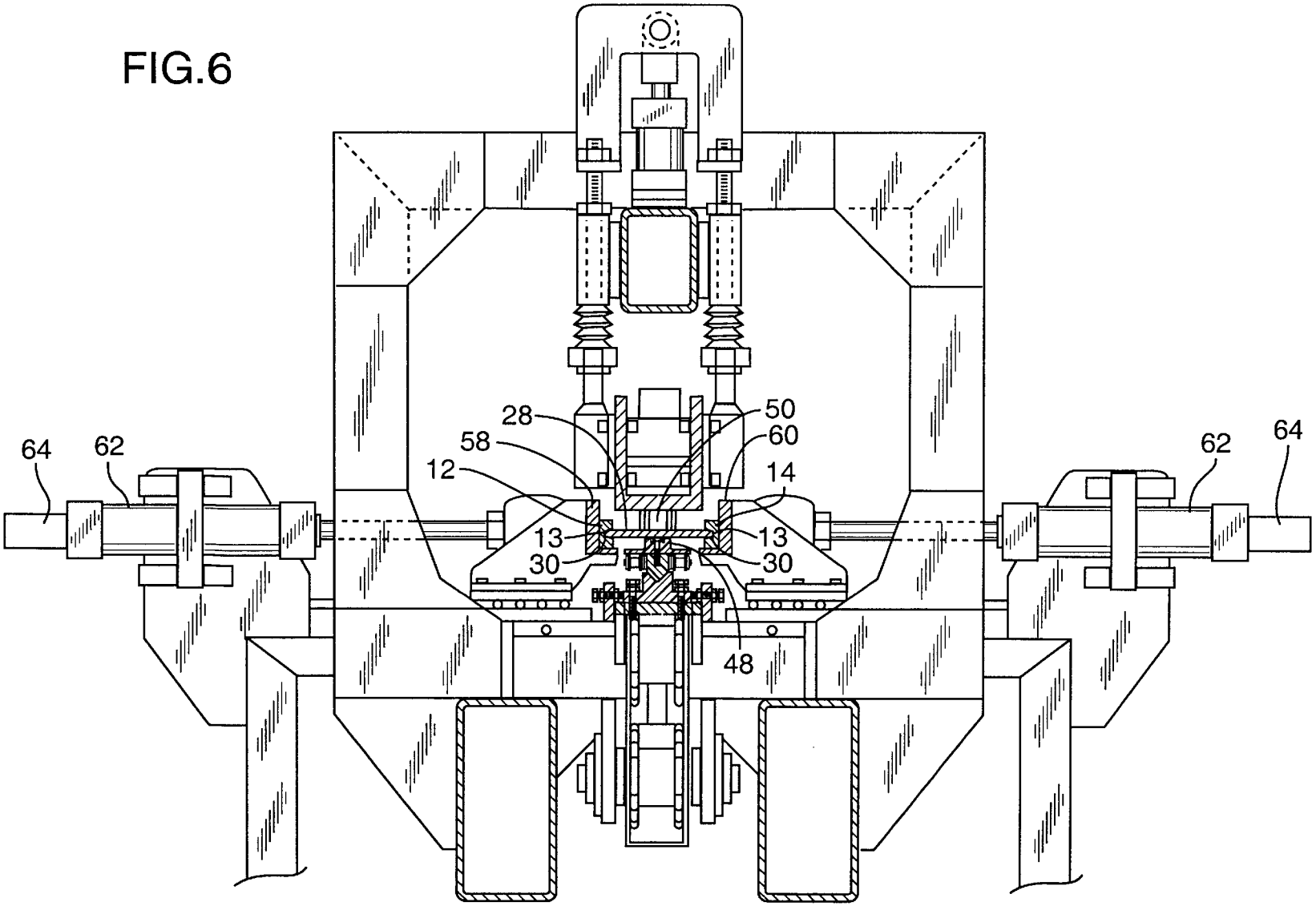
FIG. 6 is view as viewed on view lines 6—6 of FIG. 4.

The flanges 12, 14 being conveyed by the conveyors 18 and 20 as the web 28 is conveyed by conveyor 46 are forced to converge toward the web 28 by guide rails 58, 60 illustrated in FIGS. 2 and 6. The guide rails 58, 60 force the flanges 12, 14 toward the web 28 to have the side edge 30 of the web 28 inserted into the grooves 13 of the flanges 12, 14 (FIG. 6).

Also, as shown in FIG. 6, each rail 58, 60 is independently controlled and moved by independent cylinders 62. Each cylinder 62 has sensors 64 to sense the position of the cylinder. Each rail 58, 60 is independently controlled to be positioned at a known distance from the reference line 34 (shown as a dot in FIG. 6). Rail 58 is set to urge the flange 12 onto the web 28 with the side edge 30 of the web 28 seated in the groove 13 of the flange 12. Similarly rail 60 is positioned to urge the flange 14 onto the web 28 with the side edge 30 seated in the groove 13 of the flange 14.

The sharp chain conveyor 46 rigidly clamping the web 28 prevents the web from moving laterally due to the forces exerted against the web 28 as the flanges 12, 14 are urged onto the web 28. None of the force exerted by the rails 58, 60 is transmitted to the opposite side of the assembly machine. The flanges 12, 14 are by the above arrangement mounted to the web 28 independent of each other. This assures that the flanges 12, 14 will both be properly mounted to the web 28.

In the event that the flange 12 or the flange 14 may not be seated onto the web 28 due to physical limitations such as an improper groove, material in the groove that limits the insertion of the web into the groove and so forth, the rail in question and the corresponding cylinder 62 will be forced to move outwardly which is sensed by the sensor 64 to trigger a fault condition. This would alert the operator or the computer controlled program that there is a fault in the assembly of the flange to the web. That I-beam would be marked for a final inspection. Similarly, should a condition exist where one or the other or both of the rails 58, 60 move inwardly beyond the desired set point, the sensor 64 again would trigger a fault condition.

The specification for the I-beams can vary and it may therefore be necessary to change the set up of the assembly machine to accommodate a different I-beam specification. In this embodiment, the conveyors 18 and 20 which convey the flanges 12, 14 remain at a fixed height and the conveyance mechanism and related equipment that conveys the web 28 is adjusted to suit a change in the height of the flanges 12, 14. When the dimensions of the flanges 12, 14 are changed, the grooves formed in the flanges 12, 14 will be at a different height relative to the conveyance mechanism for the web 28. It is therefore necessary to adjust the conveyance mechanism for the webs 28 such that the edges of the web 28 will be aligned and may be inserted into the grooves 13 formed in the flanges 12, 14. Other machine components may be adjusted as well, e.g., the saws for cutting the grooves.

Figure 7:
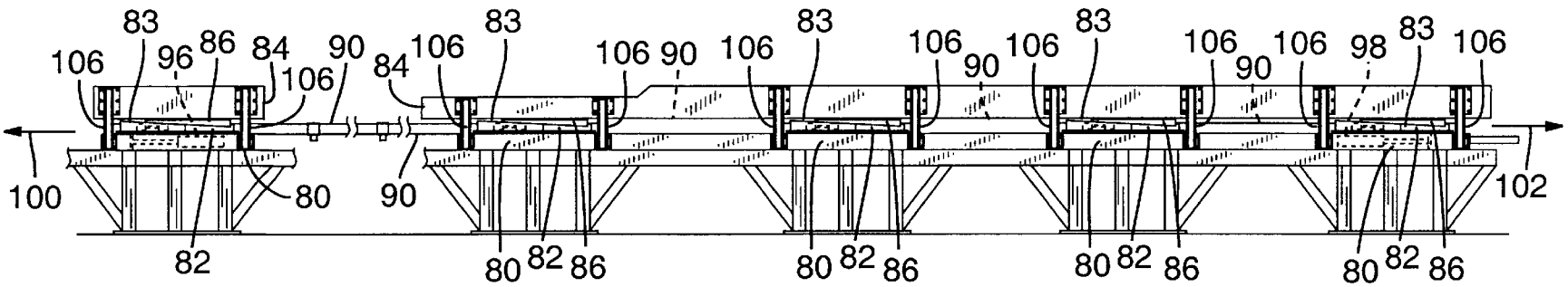
FIG. 7 is a view illustrating the height adjustment mechanism for elevating and lowering certain of the machine components relative to the flange conveyor.

FIGS. 7 (and 5) illustrates the manner of adjusting the central conveyance system for the webs 28. The central conveyance system is supported on multiple base units 80. A cam member 82 is mounted to each base unit and is slidably movable on the base unit 80. The cam member 82 has an inclined upper surface 83. Frame members 84 which support the central conveyance system are supported on the cam member 82. The base of the frame member 84 has an inclined surface 86 (follower) that mates the surface 83 of the cam member 82. Each cam member 82 is rigidly coupled to an adjacent cam member by tie rods 90. A cylinder 96 (mounted to a base unit 80) is coupled to one end cam member 82. The cylinder 96 will move the cam members 82 in the direction indicated by arrow 100. The cam members 82 will all move in the direction indicated by arrow 100 since they are coupled together by the tie rods 90. Another cylinder 98 is coupled to the opposite end cam member 82. The cylinder 98 will move the cam member in the direction indicated by arrow 102. Each of the frame members 84 have guide members 106 that prevent the frame members 84 from moving in a horizontal plane. The guide members 106 guide the movement of the frame members in the vertical plane.

When the cylinder 96 is activated to move the cam members 82 in the direction indicated by arrow 100, the inclined surface of the cam members underlying and supporting the frame members 84 is lowered and thus the central conveyance mechanism is lowered. When the cylinder 98 is activated to move the cam members 82 in the direction indicated by arrow 102, the supporting surface of the cam members 82 supporting the frame members is raised and will force the frame members 84 and thus the central conveyance mechanism to elevate.

It is important that the cams 82 all move exactly the same amount and the connections between the cams 82 and rods 90 cannot be allowed to have any slack between the connections, e.g., as may result from wearing. Tapered bolts in conjunction with spring type washers may be used for the connectors between these components which can be tightened periodically to take up any slack resulting from wear.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A wood I-beam assembly process wherein a web having opposed side edges is affixed between two flanges, the flanges each provided with a center groove configured to receive the opposed side edges of the web, which process comprises:

conveying the flanges edgewise in spaced apart relation;

positioning a web between the flanges with the edges of the web aligned with the center groove in each flange; and conveying the web in a fixed path and independently assembling each flange onto the web with the side edges of the web inserted into the center grooves of the flanges to a specific dimension.

2. A wood I-beam assembly process as defined in claim 1 which includes:

determining a reference line down the center of the web, securing the web in its fixed path of conveyance, the web thereby resisting lateral movement, and conveying each flange in a path to converge laterally toward the reference line of the web a determined spacing from the reference line for placing each flange into an assembled relation with the web, said converging of each flange producing a lateral urging force which is prevented from being transmitted to the opposing side edge by the securement of the web in its fixed path.

3. A wood I-beam assembly process as defined in claim 2 which includes:

monitoring the lateral urging force applied to each flange and releasing said lateral urging force in response to a determined excessive urging force, and in response to said releasing of the lateral urging force providing identification of the affected I-beam for follow-up inspection.

4. A continuous wood I-beam assembly process wherein webs are affixed between pairs of flanges to produce an I-beam of a desired length, which process comprises:

conveying pairs of flanges of similar lengths and substantially the desired I-beam length edgewise in spaced apart parallel relation;

positioning webs between the pairs of flanges and securing the flanges to the web, and cutting the I-beam assembly to the desired length;

avoiding side-by-side misalignment as between each pair of flanges by sensing the leading end of each flange to determine if either flange of a pair of flanges leads the other; and retarding the leading flange as required to align the leading ends of the flanges.

5. A wood I-beam assembly process as defined in claim 4 which includes producing the flanges from elongate sheets of wood cut into elongate strips and to the extent of availability, positioning strips of the same sheet of wood as the pairs of flanges to optimize the use of same length flanges as the pairs of flanges.

6. A wood I-beam assembly process as defined in claim 4 which includes;

providing sensors in the path of each flange and in a section of the pathway for the leading flange providing independent conveyance of that flange and independently controlling the conveyance of that flange to controllably retard conveyance of that flange for alignment of the leading ends of the pairs of flanges.

7. A continuous I-beam assembly process wherein pairs of flanges and webs are conveyed by a flange conveyor and a web conveyor along defined pathways for assembly thereof, the web having configured side edges inserted into a mated center groove in the flanges whereby the conveyance of the flanges and webs are coordinated to produce such assembly of the side edges of the web inserted into the center grooves of the flanges, said process having the ability to adapt to different I-beam dimensions wherein the relative height of the webs and flanges during assembly is adjusted, said adjustment provided by;

mounting the flange conveyor on a first stationary support arrangement and the web conveyor on a second stationary support arrangement independent of the first support arrangement, providing adjustability of one of the support arrangements with a laterally movable cam member having a tapered vertical dimension, laterally moving the cam member within that stationary support arrangement to produce raising and lowering of the height of the conveyor supported on that support arrangement.

8. A continuous I-beam assembly process as defined in claim 7 wherein the adjustable support arrangement is comprised of a plurality of supports and providing each support with a similar said movable cam member, and tying said plurality of movable cam members together and providing a power source for simultaneously and similarly moving said cam members for common height adjustment of the plurality of supports.

9. A continuous I-beam assembly as defined in claim 8 wherein the adjustable support arrangement is the second support arrangement.

10. A continuous I-beam assembly process as defined in claim 9 wherein the movable cam members are rigidly tied together linearly with rigid tie members and providing a power source at each end for pulling the tie members and cam members in either lateral direction for lowering and raising the supports.

* * * * *